US011322101B2

(12) United States Patent
Kang

(10) Patent No.: US 11,322,101 B2
(45) **Date of Patent: *May 3, 2022**

(54) LIQUID CRYSTAL DISPLAY DEVICE TO IMPROVE COLOR SHIFT DUE TO LARGE VIEWING ANGLE

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chih Tsung Kang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 5 days.

This patent is subject to a terminal disclaimer.

(21) Appl. No.: 17/041,138

(22) PCT Filed: Nov. 14, 2018

(86) PCT No.: PCT/CN2018/115306
§ 371 (c)(1),
(2) Date: Sep. 24, 2020

(87) PCT Pub. No.: WO2019/184382
PCT Pub. Date: Oct. 3, 2019

(65) Prior Publication Data

US 2021/0097948 A1 Apr. 1, 2021

(30) Foreign Application Priority Data

Mar. 30, 2018 (CN) ..... 201810292292.9

(51) Int. Cl.
*G09G 3/36* (2006.01)
*G09G 3/34* (2006.01)

(52) U.S. Cl.
CPC ..... *G09G 3/3607* (2013.01); *G09G 3/3406* (2013.01); *G09G 2300/0452* (2013.01);
(Continued)

(58) Field of Classification Search
None
See application file for complete search history.

(56) References Cited

U.S. PATENT DOCUMENTS

2009/0102865 A1 4/2009 Chen et al.
2017/0098405 A1* 4/2017 Koizumi ..... G09G 3/2003
(Continued)

FOREIGN PATENT DOCUMENTS

CN 104036748 A 9/2014
CN 104112436 A 10/2014
(Continued)

OTHER PUBLICATIONS

International Search Report from International Application No. PCT/CN2018/115306 dated Feb. 20, 2019.

*Primary Examiner* — Benjamin C Lee
*Assistant Examiner* — Emily J Frank

(57) ABSTRACT

Disclosed are a display device and a driving method therefor. The method comprises: decomposing, on the basis of the types of colors corresponding to original gray-scale data set to be displayed, said data set into a first gray-scale data set and a second gray-scale data set according to a set rule; and displaying the first and second gray-scale data sets in two continuous periods of time, respectively.

16 Claims, 3 Drawing Sheets

(52) U.S. Cl.
CPC ..... *G09G 2320/0242* (2013.01); *G09G 2320/0252* (2013.01); *G09G 2320/0626* (2013.01)

(56) References Cited

U.S. PATENT DOCUMENTS

| | | | | |
|---|---|---|---|---|
| 2020/0226987 | A1* | 7/2020 | Shan | G09G 3/3607 |
| 2020/0279518 | A1* | 9/2020 | Pyo | G09G 3/3233 |
| 2021/0350753 | A1* | 11/2021 | Huang | G09G 3/36 |

FOREIGN PATENT DOCUMENTS

| | | | |
|---|---|---|---|
| CN | 104299575 | A | 1/2015 |
| CN | 104464649 | A | 3/2015 |
| CN | 104570430 | A | 4/2015 |
| CN | 107657928 | A | 2/2018 |
| CN | 107808648 | A | 3/2018 |
| CN | 108346406 | A | 7/2018 |

* cited by examiner

LIQUID CRYSTAL DISPLAY DEVICE TO IMPROVE COLOR SHIFT DUE TO LARGE VIEWING ANGLE

TECHNICAL FIELD

This application relates to the field of liquid crystal display technology, and in particular to a driving method for a liquid crystal display device and a liquid crystal display device.

BACKGROUND

Among the large-viewing-angle and front-viewing-angle color shift variations of various representative color systems of liquid crystal displays, color systems of red, green and blue have more serious large-viewing-angle color shift than other color systems. Furthermore, due to the rapid saturation increase of the viewing angle brightness ratio of the gray scale liquid crystal display, the lower the gray-scale value is, the greater the difference between the front-viewing-angle brightness and the side-viewing-angle brightness will be.

At present, a method for alleviating color shift is as follows: each sub-pixel is subdivided into a primary pixel and a secondary pixel, the primary pixel is driven by a higher driving voltage, the secondary pixel is driven by a lower drive voltage, and the primary pixel and the secondary pixel together display one sub-pixel. When the primary pixel and the secondary pixel are respectively driven by the higher driving voltage and the lower driving voltage, the relationship between the brightness at the front viewing angle and a corresponding gray scale can be maintained unchanged. The method is generally as follows: in the first half of the gray scale, the primary pixel is driven by the higher driving voltage for display, the secondary pixel is not displayed, and the brightness of the entire sub-pixel is half of the brightness of the primary pixel; and in the latter half of the gray scale, the primary pixel is driven by the higher driving voltage for display, the secondary pixel is driven by the lower drive voltage for display, and the brightness of the entire sub-pixel is half of the sum of the brightness of the primary pixel and the brightness of the secondary pixel. After such synthesis, the color shift at a large-viewing-angle is alleviated to some extent. However, the above method has the problem that it is necessary to double the metal routing and driving devices to drive the secondary pixel, so that a light-transmissive opening area is sacrificed, the transmittance of the panel is affected, and the cost is also higher.

SUMMARY

Based on this, this application provides a driving method for a liquid crystal display device and a liquid crystal display device to alleviate the large-viewing-angle color shift while ensuring that the cost is not increased.

This application provides a driving method for a liquid crystal display device, the liquid crystal display device including a display module, the display module including a plurality of pixel units arranged in an array, and the driving method including:

determining a type of a color corresponding to an original gray-scale data group to be displayed by each of the pixel units;

dividing the original gray-scale data group into a first gray-scale data group and a second gray-scale data group in accordance with a set grouping rule according to the type of the color corresponding to the original gray-scale data group to be displayed by each of the pixel units; and outputting and displaying the first gray-scale data group and the second gray-scale data group respectively in two consecutive time periods.

Based on the same inventive concept, this application further provides a driving method for a liquid crystal display device, the liquid crystal display device including a display module, the display module including a plurality of pixel units arranged in an array, and the driving method including:

determining a type of a color corresponding to an original gray-scale data group to be displayed by an $n^{th}$ pixel unit;

dividing the original gray-scale data group into a first gray-scale data group and a second gray-scale data group in accordance with a set grouping rule according to the type of the color corresponding to the original gray-scale data group to be displayed by the $n^{th}$ pixel unit; and outputting and displaying the first gray-scale data group and the second gray-scale data group respectively in two consecutive time periods;

wherein n is an integer greater than or equal to 1.

Based on the same inventive concept, this application further provides a liquid crystal display device, the liquid crystal display device including:

a display module, configured to display graphic and text information;

a drive module, configured to receive, process and output driving data to control the display module to normally work; and a backlight module, configured to convert a direct current voltage into a high-frequency high-voltage alternating current to turn on a backlight unit;

wherein the display module includes a plurality of pixel units arranged in an array;

the pixel unit includes a red sub-pixel, a green sub-pixel and a blue sub-pixel;

the drive module includes a gray-scale data decomposition processing unit;

the gray-scale data decomposition processing unit is configured to decompose an input original gray-scale data group corresponding to each of the pixel units into two new gray-scale data groups, and output gray-scale values of the red sub-pixel, the green sub-pixel and the blue sub-pixel in each of the pixel units in two consecutive time periods;

the gray-scale data decomposition processing unit is connected to all the red sub-pixels, the green sub-pixels and the blue sub-pixels in the display module; and the backlight module includes a power processing unit and the backlight unit.

According to the above methods and device, the low-gray-scale-containing original gray-scale data group corresponding to the red sub-pixel, the green sub-pixel and the blue sub-pixel in the pixel unit is decomposed into zero gray-scale value-containing gray-scale value groups for presentation, one with all low gray-scale values and the other with a lowest non-zero gray-scale value removed. Because of the rapid saturation increase of the viewing angle brightness ratio of the gray scale liquid crystal display, the lower the gray-scale value is, the greater the difference between the front-viewing-angle brightness and the side-viewing-angle brightness will be. Therefore, the brightness ratio of the dominant hue is increased, so that the color shift caused by the large-viewing-angle main color tone being affected by the low-voltage sub-pixel is alleviated. In addition, the main signal brightness presentation under a large-viewing-angle condition can be increased, the brightness of the overall image display can be maintained unchanged by increasing the backlight brightness to twice of original brightness, and the speed of the overall image display can be maintained unchanged by increasing a driving frequency to twice of an original driving frequency. Meanwhile, this application does not require additional wiring on the liquid crystal display panel.

DETAILED DESCRIPTION OF THE EMBODIMENTS

To make the objectives, technical solutions, and advantages of this application clearer and more comprehensible, the following further describes this application in detail with reference to the accompanying drawings and embodiments. It should be understood that the specific embodiments described herein are merely used to explain this application but are not intended to limit this application.

Figure 1:
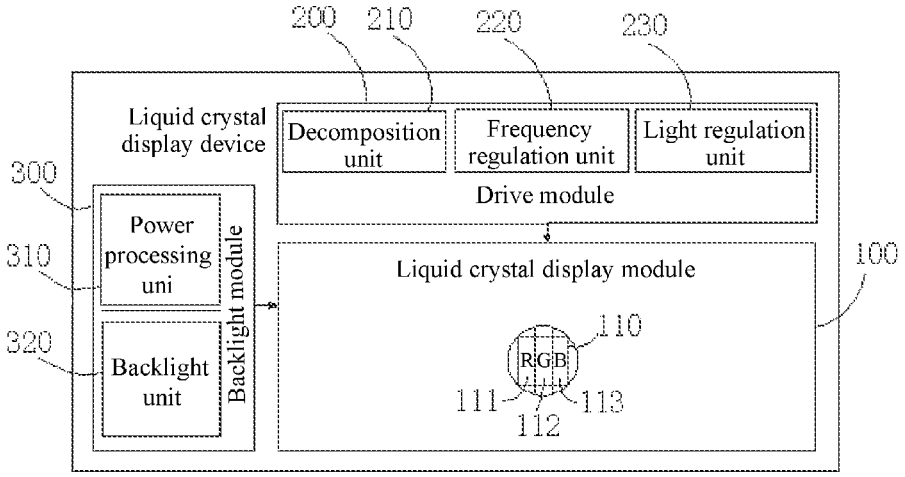
FIG. 1 is a schematic structural diagram of modules of a liquid crystal display device.

An embodiment of this application provides a driving method for a liquid crystal display device, as shown in FIG. 1, the liquid crystal display device including a display module 100. The display module 100 includes a plurality of pixel units 110 arranged in an array. The driving method is as follows.

A type of a color corresponding to an original gray-scale data group to be displayed by each of the pixel units 110 is determined.

The original gray-scale data group is divided into a first gray-scale data group and a second gray-scale data group in accordance with a set grouping rule according to the type of a color corresponding to the original gray-scale data group to be displayed by each of the pixel units 110.

The first gray-scale data group and the second gray-scale data group are respectively output and displayed in two consecutive time periods.

In the above method, the pixel unit 110 may be a combination of a red sub-pixel 111, a green sub-pixel 112 and a blue sub-pixel 113, or may be another color sub-pixel combination type. The pixel unit 110 generates a color for each gray-scale value group received. The gray-scale value group is generated by gray-scale data input to the liquid crystal display device. The gray-scale value group includes a red gray-scale value, a green gray-scale value and a blue gray-scale value. The color generated by the pixel unit 110 may be any one of a unitary color type, a binary mixed color type and a ternary mixed color type, or may be a combined mixed color type of sub-pixels of non-unitary colors.

The type of the color corresponding to the original gray-scale data is determined according to the amount of zero gray-scale data in the original gray-scale data group to be displayed by each of the pixel units 110. A determining method is as follows.

When the original gray-scale data group does not include the zero gray-scale data, it is determined that the color corresponding to the original gray-scale data group is a ternary mixed color.

When the original gray-scale data group includes one piece of zero gray-scale data, it is determined that the color corresponding to the original gray-scale data group is a binary mixed color.

When the original gray-scale data group includes two pieces of zero gray-scale data, it is determined that the color corresponding to the original gray-scale data group is a unitary color.

Figure 2:
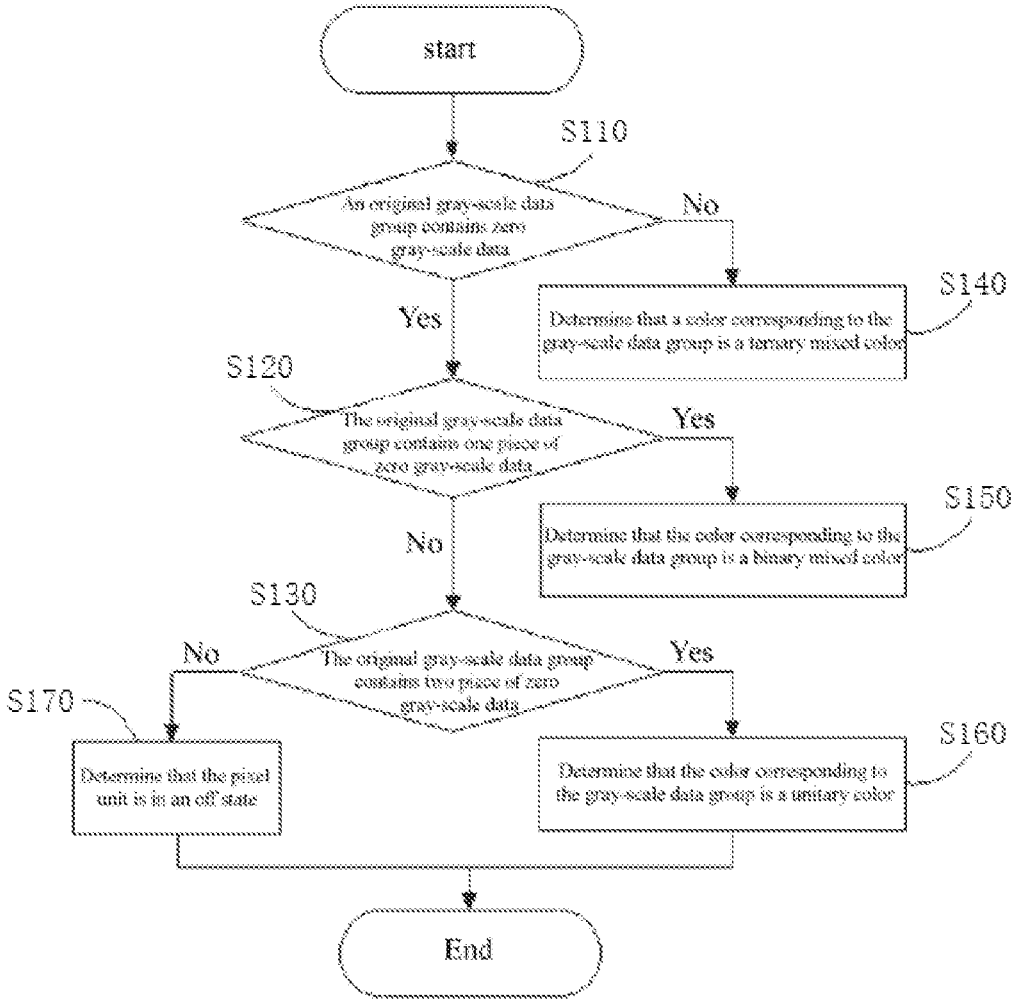
FIG. 2 is a flowchart of determining a type of a display color of a pixel unit corresponding to an original gray-scale data group in a driving method.

Specifically, as shown in FIG. 2, an embodiment method of determining the type of the color corresponding to the original gray-scale data group to be displayed by each of the pixel units 110 includes steps S110-S170.

Step S110: It is determined whether the original gray-scale data group to be displayed by each of the pixel units 110 contains the zero gray-scale data, and if not, step S140 is performed; otherwise, step S120 is performed. A certain color being a ternary mixed color type indicates that the color includes colors of three components of red, green and blue. In the field of liquid crystal display technology, the gray-scale values of the red sub-pixel, the green sub-pixel and the blue sub-pixel in the corresponding pixel unit are non-zero, that is, the corresponding original gray-scale data group does not contain zero gray-scale data, so it can be determined whether the original gray-scale data group is a ternary mixed color gray-scale data group by determining whether the original gray-scale data group contains zero gray-scale data.

Step S120: It is determined whether the original gray-scale data group to be displayed by each of the pixel units 110 only contains one piece of zero gray-scale data, and if yes, step S150 is performed; otherwise, step S130 is performed. A certain color being a ternary mixed color type indicates that the color includes any two colors of three components of red, green and blue. In the field of liquid crystal display technology, only one of the gray-scale values of the red sub-pixel, the green sub-pixel and the blue sub-pixel in the corresponding pixel unit is zero, and the other two are non-zero, that is, the corresponding original gray-scale data group only contains one piece of zero gray-scale data, so it can be determined whether the original gray-scale data group is a binary mixed color gray-scale data group by determining whether the original gray-scale data group only contains one piece of zero gray-scale data.

Step S130: It is determined whether the original gray-scale data group to be displayed by each of the pixel units only contains two pieces of zero gray-scale data, and if yes, step S160 is performed; otherwise, step S170 is performed. A certain color being a unitary color type indicates that the color includes any one of three components of red, green and blue. In the field of liquid crystal display, only two of the gray-scale values of the red sub-pixel, the green sub-pixel and the blue sub-pixel in the corresponding pixel unit are zero, and the other one is non-zero, that is, the corresponding original gray-scale data group only contains two pieces of zero gray-scale data, so it can be determined whether the original gray-scale data group is a unitary color gray-scale data group by determining whether the original gray-scale data group only contains two pieces of zero gray-scale data.

Step S140: It is determined that the color displayed by the pixel unit corresponding to the gray-scale data group is a ternary mixed color.

Step S150: It is determined that the color displayed by the pixel unit corresponding to the gray-scale data group is a binary mixed color.

Step S160: It is determined that the color displayed by the pixel unit corresponding to the gray-scale data group is a unitary color.

Step S170: It is determined that the pixel unit corresponding to the gray-scale data group is in an off state. When the gray-scale values of the sub-pixels of a certain pixel unit are all zero, it indicates that the pixel unit is not in charge of a display task. At this time, the voltage of each sub-pixel of the pixel unit is zero, and the pixel unit is in an off state. Since light cannot pass through liquid crystals, the pixel unit appears black.

The pixel unit 110 includes the red sub-pixel 111, the green sub-pixel 112 and the blue sub-pixel 113. The color generated by the pixel unit 110 may be any one of a unitary color type, a binary mixed color type and a ternary mixed color type, and the grouping rule specifically includes the followings.

Minimum original gray-scale data in the original gray-scale data group corresponding to the ternary mixed color pixel unit 110 is used as common gray-scale data of the red sub-pixel 111, the green sub-pixel 112 and the blue sub-pixel 113 in the pixel unit to form the first gray-scale data group.

Minimum non-zero gray-scale data in a difference data group obtained by subtracting the first gray-scale data group from the original gray-scale data group corresponding to the ternary mixed color pixel unit 110 is used as common gray-scale data of the sub-pixels corresponding to non-zero gray-scale data in the difference data group to form the second gray-scale data group together with the zero gray-scale data.

Alternatively, the minimum non-zero gray-scale data in the original gray-scale data group corresponding to the binary mixed color pixel unit 110 is used as common gray-scale data of the sub-pixels corresponding to two pieces of non-zero gray-scale data in the pixel unit 110 to form the first gray-scale data group together with the zero gray-scale data. The first gray-scale data group is subtracted from the original gray-scale data group, an obtained difference data group being used as the second gray-scale data group of the pixel unit 110.

Alternatively, gray-scale data corresponding to half of gray-scale values corresponding to the non-zero gray-scale data in the original gray-scale data group corresponding to the unitary color pixel unit 110 is used as gray-scale data of the sub-pixel corresponding to the non-zero gray-scale data in the pixel unit 110 to respectively form the first gray-scale data group and the second gray-scale data group together with the zero gray-scale data.

Figure 3:
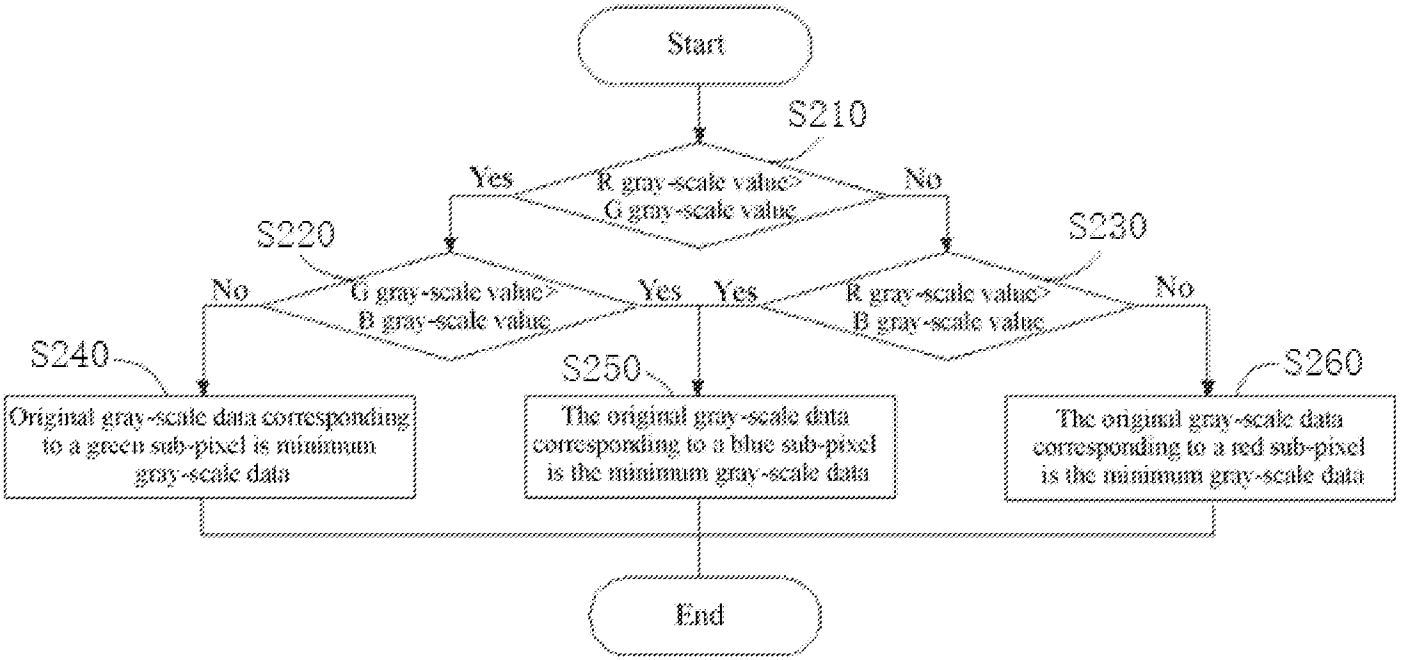
FIG. 3 is a flowchart of determining minimum gray-scale data in a ternary mixed color gray-scale data group in a driving method.

An embodiment shown in FIG. 3 is a method for determining minimum gray-scale data in a ternary mixed color gray-scale data group, which specifically includes steps S210-S260.

Step S210: It is determined whether a red gray-scale value in an original gray-scale value group corresponding to an original gray-scale data group to be displayed by the ternary mixed color pixel unit is greater than a green gray-scale value, and if yes, step S220 is performed; otherwise, step S230 is performed. The step of firstly determining the magnitude relationship between the gray-scale value corresponding to the red sub-pixel 111 and the gray-scale value of the green sub-pixel 112 is merely a case listed for convenience of explanation, and actually, the gray-scale values of any two colors of the red, green and blue sub-pixels may be adopted to perform determination firstly.

Step S220: It is determined whether the green gray-scale value in the original gray-scale value group is greater than a blue gray-scale value, and if yes, step S250 is performed; otherwise, step S240 is performed. The step is to perform comparison and determination on the smaller gray-scale value in step S120 and a gray-scale value of another color, and output a corresponding determination result and an action signal.

Step S230: It is determined whether the red gray-scale value in the original gray-scale value group is greater than the blue gray-scale value, and if yes, step S250 is performed; otherwise, step S260 is performed. The step is to perform comparison and determination on the smaller gray-scale value in step S120 and the gray-scale value of another color, and output a corresponding determination result and the action signal.

Step S240: It is determined that the gray-scale data corresponding to the green sub-pixel in the original gray-scale data group is minimum original gray-scale data.

Step S250: It is determined that the gray-scale data corresponding to the blue sub-pixel in the original gray-scale data group is the minimum original gray-scale data.

Step S260: It is determined that the gray-scale data corresponding to the red sub-pixel in the original gray-scale data group is the minimum original gray-scale data.

Figure 4:
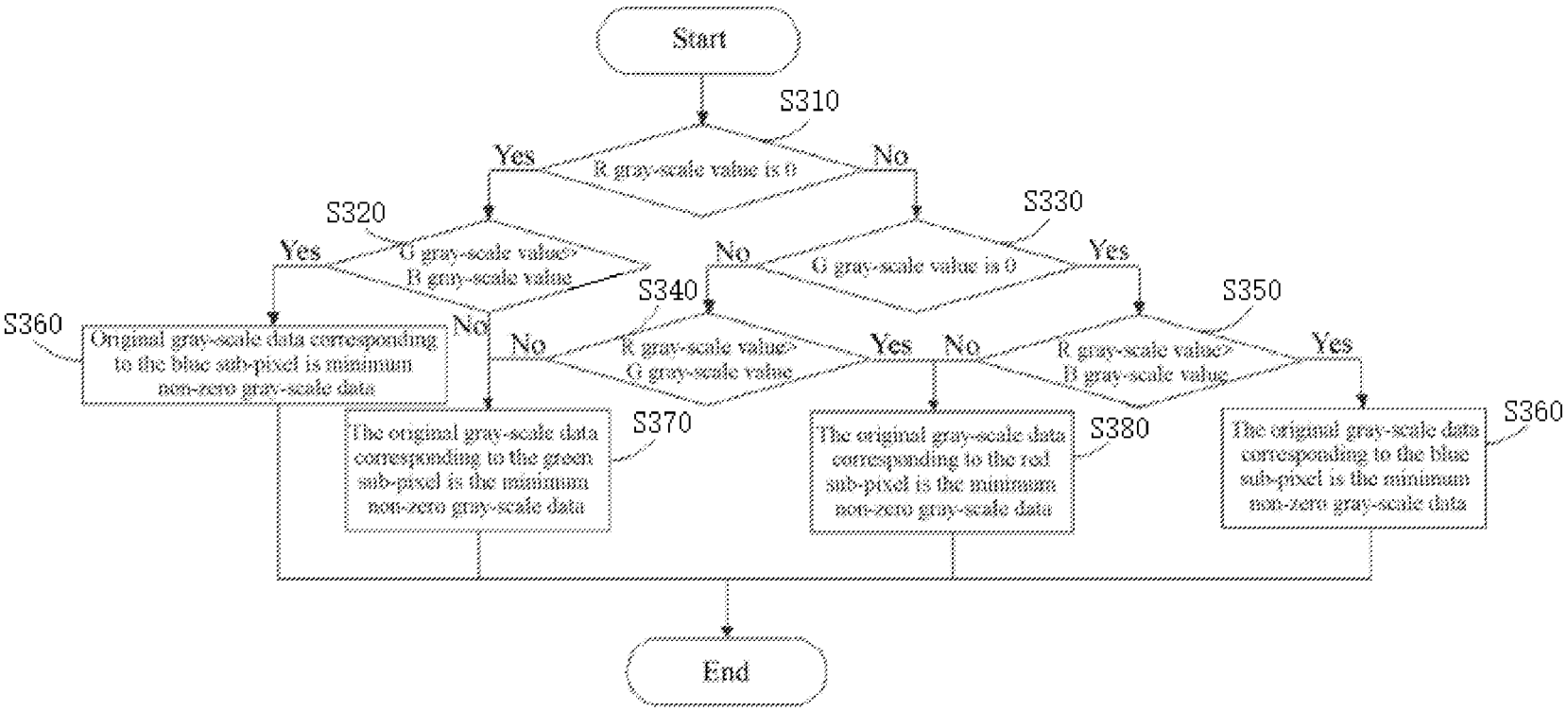
FIG. 4 is a flowchart of determining minimum non-zero gray-scale data in a binary mixed color gray-scale data group in a driving method.

An embodiment shown in FIG. 4 is a method for determining minimum non-zero gray-scale data in a binary mixed color gray-scale data group, which specifically includes steps S310-S380.

Step S310: It is determined whether a red gray-scale value in an original gray-scale value group corresponding to an original gray-scale data group to be displayed by the binary mixed color pixel unit is zero, and if yes, step S320 is performed; otherwise, step S330 is performed.

A certain color being a binary mixed color type indicates that the color includes any two colors of three components of red, green and blue. In the field of liquid crystal display technology, only one of gray-scale values of the red sub-pixel 111, the green sub-pixel 112 and the blue sub-pixel 113 in the corresponding pixel unit 110 is zero, and the other two are non-zero, that is, the corresponding original gray-scale data group only contains one piece of zero gray-scale data. Step S310 of firstly determining whether the gray-scale value corresponding to the red sub-pixel 111 is zero is merely a case listed for convenience of explanation, and actually, the gray-scale value of one color of the red, green and blue sub-pixels may be adopted to perform determination firstly.

Step S320: It is determined whether a green gray-scale value corresponding to the pixel unit with the red sub-pixel gray-scale value of zero is greater than a blue gray-scale value, and if yes, step S360 is performed; otherwise, step S370 is performed. According to the step, it is determined that a color displayed by the pixel unit 110 is a mixed color of green and blue when determining that the gray-scale value corresponding to the red sub-pixel 111 is zero, so the minimum non-zero gray-scale data in the original gray-scale data group corresponding to the pixel unit 110 can be determined by determining the magnitude relationship between the green gray-scale value and the blue gray-scale value.

Step S330: It is determined whether the green gray-scale value corresponding to the pixel unit with the red sub-pixel gray-scale value being non-zero is zero, and if yes, step S350 is performed; otherwise, step S340 is performed. The step of firstly determining that the gray-scale value corresponding to the red sub-pixel 111 is non-zero and then determining whether the gray-scale value corresponding to the green sub-pixel 112 is zero is merely a case listed for convenience of explanation, and actually, the gray-scale value of the blue sub-pixel may be adopted to perform determination.

Step S340: It is determined whether the red gray-scale value corresponding to the pixel unit with the blue sub-pixel gray-scale value being zero is greater than the green gray-scale value, and if yes, step S380 is performed; otherwise, step S370 is performed. According to the step, it is determined that the color displayed by the pixel unit is a mixed color of green and red when determining that the gray-scale value corresponding to the blue sub-pixel 113 is zero, so the minimum non-zero gray-scale data in the original gray-scale data group corresponding to the pixel unit can be determined by determining the magnitude relationship between the green gray-scale value and the red gray-scale value.

Step S350: It is determined whether the red gray-scale value corresponding to the pixel unit with the green sub-pixel gray-scale value being zero is greater than the blue gray-scale value, and if yes, step S360 is performed; otherwise, step S380 is performed. According to the step, it is determined that the color displayed by the pixel unit is a mixed color of red and blue when determining that the gray-scale value corresponding to the blue sub-pixel 112 is zero, so the minimum non-zero gray-scale data in the original gray-scale data group corresponding to the pixel unit can be determined by determining the magnitude relationship between the red gray-scale value and the blue gray-scale value.

Step S360: It is determined that original gray-scale data corresponding to the blue sub-pixel in the original gray-scale data group corresponding to the binary mixed color pixel unit is the minimum non-zero gray-scale data.

Step S370: It is determined that the original gray-scale data corresponding to the green sub-pixel in the original gray-scale data group corresponding to the binary mixed color pixel unit is the minimum non-zero gray-scale data.

Step S380: It is determined that the original gray-scale data corresponding to the red sub-pixel in the original gray-scale data group corresponding to the binary mixed color pixel unit is the minimum non-zero gray-scale data.

In the grouping rule, due to the rapid saturation increase of the viewing angle brightness ratio of the gray scale liquid crystal display, the lower the gray-scale value is, the greater the difference between the front-viewing-angle brightness and the side-viewing-angle brightness will be. Therefore, in order to highlight the dominant color and alleviate the color shift, the minimum gray-scale data in the original gray-scale data group is displayed in a separate group of gray-scale data, and the color that does not contain the lowest gray-scale data can be displayed in other groups, thereby preventing the lowest gray scale color in the group from affecting the display of the dominant color due to the rapid saturation increase of the viewing angle brightness ratio of the gray scale liquid crystal display. In order to explain the grouping rule more clearly and directly, the following grouping description is performed on the gray-scale value group. It should be noted that the grouping process is data grouping performed when the original gray-scale data group is processed. Here, the gray-scale value group is used for illustration just for convenience and simplicity.

It is assumed that the original gray-scale data group corresponding to a certain pixel unit 110 is converted into an original gray-scale value group (A, B, C), that is, the gray-scale value corresponding to the red sub-pixel 111 is A, the gray-scale value corresponding to the green sub-pixel 112 is B, and the gray-scale value corresponding to the blue sub-pixel 113 is C. When A>B>C, it can be determined that the gray-scale value corresponding to the blue sub-pixel 113 is a minimum gray-scale value in the original gray-scale values, that is, a lowest gray-scale value, and the difference between the front-viewing-angle brightness and the side-viewing-angle brightness of the lowest gray-scale value is the largest. In order to reduce the effect of the lowest gray-scale value, the lowest gray-scale value is used as a common gray-scale value of the red sub-pixel 111, the green sub-pixel 112 and the blue sub-pixel 113 to form the first gray-scale value group (C, C, C). The lowest gray-scale value is respectively subtracted from the gray-scale values corresponding to the red sub-pixel 111, the green sub-pixel 112 and the blue sub-pixel 113 in the original gray-scale data, an obtained difference group being used as the second gray-scale value group (A-C, B-C, zero). So the lowest gray-scale value can be removed from the second gray-scale value group, the effect of the lowest gray-scale value on the color shift under a large-viewing-angle condition when the second gray-scale value group is displayed can be eliminated, and the ratio of the sum of the gray-scale values of the dominant color after decomposition to the lower gray-scale value is increased, thereby alleviating the color shift at a side-viewing-angle, and increasing the brightness of the dominant color.

In the above content, the gray-scale value data group and the gray-scale value group both use the pixel unit 110 as the minimum unit, and are data groups respectively including gray-scale data or gray-scale values respectively corresponding to the red sub-pixel 111, the green sub-pixel 112 and the blue sub-pixel 113. The original gray-scale data group refers to an original gray-scale value data group input by the display device, including red, green and blue gray-scale data. The original gray-scale value group refers to a gray-scale value group directly converted from the original gray-scale data group, including red, green and blue gray-scale data.

In the above grouping rule, the original gray-scale data group corresponding to the binary mixed color and the unitary color is decomposed into two gray-scale data groups, so as to keep the synchronization with the execution control manner of the ternary mixed color gray-scale data group and facilitate driving and control.

Further, the liquid crystal display device further includes a drive module. The drive module is configured to receive, process and output driving data. The driving method further includes increasing a driving frequency of each of the pixel units to 1 to 3 times of original frequency to compensate for a display speed which is lowered due to the gray-scale value decomposition. The original gray-scale value is decomposed into two gray-scale values which are displayed in two consecutive time periods, so that the display time of the picture is doubled, that is, the display speed is reduced by half. In order to compensate for the display speed which is lowered due to the gray-scale value decomposition, the driving frequency can be increased.

In some embodiments, the driving frequency of each of the pixel units is increased to 2 times of an original driving frequency to maintain the display speed of the pixel unit after the gray-scale value decomposition to be the same as the display speed before the gray-scale value decomposition. Such setting is to achieve that the smoothness of a picture displayed after the gray-scale value decomposition to be substantially the same as the smoothness of the picture displayed by the original gray-scale data, thereby alleviating the color shift problem of the liquid crystal display without impairing the original visual effect.

In some embodiments, the liquid crystal display device further includes a backlight module 300. The backlight module 300 includes a backlight unit 320 configured to provide a backlight source. The driving method further includes increasing the brightness of the backlight unit 320 to 1 to 3 times of original brightness to compensate for the display brightness which is lowered due to the gray-scale value decomposition, or the driving frequency increase or the joint action of the gray-scale value decomposition and the driving frequency increase. Since the process of gray-scale value decomposition is to decompose the original high gray-scale value into two new low gray-scale values, that is, in practice, a group of high voltage signals is decomposed into two groups of low voltage signals, so the brightness is lowered. On the other hand, since the original one gray-scale value is decomposed into two gray-scale values which are displayed in two consecutive time periods, the display time of the picture is twice of original display time, that is, the display speed is reduced by half of original display speed. In order to compensate for the display speed which is lowered due to the gray-scale value decomposition, the driving frequency is generally increased. After the driving frequency is increased, the brightness is lowered because the actual display time of each gray-scale data group is shorter than that at the original driving frequency. For example, if the original driving frequency is increased to twice of the original driving frequency, the actual display time of a driving signal becomes ½ of original driving signal time, causing the reduction of the brightness. In order to compensate for the brightness which is lowered due to the gray-scale value decomposition, or the driving frequency increase or the joint action of the gray-scale value decomposition and the driving frequency increase, the backlight brightness can be increased.

In some embodiments, the brightness of the backlight unit 320 is increased to 2 times of original brightness to maintain the brightness of the pixel unit after the gray-scale value decomposition to be the same as the brightness before the gray-scale value decomposition. Such setting is to achieve that the display effect after the gray-scale value decomposition is substantially the same as the display effect of the original gray-scale data, thereby alleviating the color shift problem of the liquid crystal display without impairing the original visual effect.

In the above method, the type of the color corresponding to the original gray-scale data group to be displayed by each of the pixel units is determined, the original gray-scale data group is divided into a first gray-scale data group and a second gray-scale data group in accordance with a set grouping rule according to the type of the color corresponding to the original gray-scale data group to be displayed by each of the pixel units, and the first gray-scale data group and the second gray-scale data group are respectively output and displayed in two consecutive time periods. Such setting increases the brightness ratio of the dominant hue, so that the color shift due to the large-viewing-angle dominant hue being affected by the low voltage sub-pixel is alleviated. In addition, a main signal brightness presentation under a large-viewing-angle condition can be increased, furthermore, the brightness of the overall image display can be maintained unchanged by increasing the backlight brightness to 2 times of original brightness, and the speed of the overall image display can be maintained unchanged by increasing the driving frequency to 2 times of the original driving frequency. Meanwhile, this application does not require additional wiring on the liquid crystal display panel.

In some embodiments, the backlight unit 320 may be an RGB type LED lamp, a white light type LED lamp or other light sources, which is not limited herein.

In some embodiments, the pixel unit 110 includes 4 or more than 4 sub-pixels of different colors.

In some embodiments, the pixel unit 110 includes 4 sub-pixels of different colors, and may include, in addition to the red sub-pixel 111, the green sub-pixel 112, and the blue sub-pixel 113, for example, a white sub-pixel, a yellow sub-pixel, an orange sub-pixel or other color sub-pixel.

In some embodiments, the pixel unit 110 includes a plurality of sub-pixels of different colors. For example, the pixel unit includes sub-pixels of a white sub-pixel, a yellow sub-pixel and an orange sub-pixel.

This application further provides a driving method for a liquid crystal display device, the liquid crystal display device including a display module. The display module includes a plurality of pixel units arranged in an array. The driving method includes the followings.

The type of a color corresponding to an original gray-scale data group to be displayed by an $n^{th}$ pixel unit is determined.

The original gray-scale data group is divided into a first gray-scale data group and a second gray-scale data group in accordance with a set grouping rule according to the type of the color corresponding to the original gray-scale data group to be displayed the $n^{th}$ pixel unit.

The first gray-scale data group and the second gray-scale data group are respectively output and displayed in two consecutive time periods.

Therein n is an integer greater than or equal to 1.

In some embodiments, the pixel unit includes a plurality of sub-pixels of different colors.

In some embodiments, the pixel unit includes a red sub-pixel, a green sub-pixel and a blue sub-pixel. The pixel unit generates a color for each gray-scale value group received. The gray-scale value group is generated by gray-scale data input to the display device. The gray-scale value group includes a red gray-scale value, a green gray-scale value and a blue gray-scale value. The color generated by the pixel unit is any one of a unitary color type, a binary mixed color type and a ternary mixed color type.

The above driving method can be used by the liquid crystal display device for a set area, or for a partial area according to the nature of display data. Such setting allows the increase of the brightness ratio of the dominant hue of the liquid crystal display area using the above driving method, so that the color shift due to the large-viewing-angle dominant hue being affected by the low voltage sub-pixel is alleviated. In addition, a main signal brightness presentation under a large-viewing-angle condition in the liquid crystal display area using the above driving method can be increased, furthermore, the brightness of the overall image display can be maintained unchanged by increasing the backlight brightness to 2 times of original brightness, and the speed of the overall image display can be maintained unchanged by increasing the driving frequency to 2 times of the original driving frequency. Meanwhile, this application does not require additional wiring on the liquid crystal display panel.

Further, this application further provides a driving method for a liquid crystal display device as follows.

As shown in FIG. 1, the liquid crystal display device includes a display module 100. The display module 100 includes a plurality of pixel units 110 arranged in an array. The pixel unit includes a red sub-pixel 111, a green sub-pixel 112 and a blue sub-pixel 113. A color generated by the pixel unit 110 is any one of a unitary color type, a binary mixed color type and a ternary mixed color type. The driving method of the liquid crystal display device includes the followings.

The type of the color corresponding to an original gray-scale data group to be displayed by the pixel unit 110 is determined.

The original gray-scale data group is divided into a first gray-scale data group, a second gray-scale data group and a third gray-scale data group in accordance with a set grouping rule according to the type of the color corresponding to the original gray-scale data group to be displayed by the pixel unit 110.

The first gray-scale data group, the second gray-scale data group and the third gray-scale data group are respectively output and displayed in three consecutive time periods.

The grouping rule specifically includes the followings.

Minimum original gray-scale data in the original gray-scale data group corresponding to the ternary mixed color pixel unit 110 is used as common gray-scale data of the red sub-pixel 111, the green sub-pixel 112 and the blue sub-pixel 113 in the pixel unit to form the first gray-scale data group.

Minimum non-zero gray-scale data in a difference data group obtained by subtracting the first gray-scale data group from the original gray-scale data group corresponding to the ternary mixed color pixel unit 110 is used as common gray-scale data of the sub-pixels corresponding to the non-zero gray-scale data in the difference data group to form the second gray-scale data group together with the zero gray-scale data.

The difference data group obtained by subtracting the first gray-scale data group and the second gray-scale data group from the original gray-scale data group corresponding to the ternary mixed color pixel unit 110 is used as the third gray-scale data group.

Zero gray-scale data in the original gray-scale data group corresponding to the binary mixed color pixel unit 110 is used as common gray-scale data of the red sub-pixel 111, the green sub-pixel 112 and the blue sub-pixel 113 in the pixel unit to form the first gray-scale data group.

Minimum non-zero gray-scale data in the original gray-scale data group corresponding to a binary mixed color pixel unit 110 is used as common gray-scale data of the sub-pixels corresponding to the non-zero gray-scale data in the original gray-scale data group to form the second gray-scale data group together with the zero gray-scale data.

A difference data group obtained by subtracting the second gray-scale data group from the original gray-scale data group corresponding to the binary mixed color pixel unit 110 is used as the third gray-scale data group.

Alternatively, gray-scale data corresponding to half of the gray-scale value corresponding to the minimum non-zero gray-scale data in the original gray-scale data group corresponding to the binary mixed color pixel unit 110 is used as common gray-scale data of the sub-pixels corresponding to the two pieces of non-zero gray-scale data in the pixel unit 110 to respectively form the first gray-scale data group and the second gray-scale data group together with the zero gray-scale data.

The difference data group obtained by subtracting the first gray-scale data group and the second gray-scale data group from the original gray-scale data group corresponding to the binary mixed color pixel unit 110 is used as the third gray-scale data group.

Any zero gray-scale data in the original gray-scale data group corresponding to the unitary color pixel unit 110 is used as common gray-scale data of the red sub-pixel, the green sub-pixel and the blue sub-pixel in the pixel unit to form the first gray-scale data group and the second gray-scale data group.

The original gray-scale data group corresponding to the unitary color pixel unit 110 is used as the third gray-scale data group.

Alternatively, the gray-scale data corresponding to one-third of the gray-scale value corresponding to the non-zero gray-scale data in the original gray-scale data group corresponding to the unitary color pixel unit 110 is used as gray-scale data of the sub-pixel corresponding to the non-zero gray-scale data in the pixel unit to respectively form the first gray-scale data group, the second gray-scale data group and the third gray-scale data group together with the zero gray-scale data.

The above grouping rule can be summarized as follows:

It is assumed that the original gray-scale data group corresponding to a certain pixel unit 110 is converted into an original gray-scale value group (A, B, C), that is, the gray-scale value corresponding to the red sub-pixel 111 is A, the gray-scale value corresponding to the green sub-pixel 112 is B, and the gray-scale value corresponding to the blue sub-pixel 113 is C. When A>B>C, it can be determined that the gray-scale value corresponding to the blue sub-pixel 113 is the minimum gray-scale value in the original gray-scale value, that is, the lowest gray-scale value, and the difference between the front-viewing-angle brightness and the side-viewing-angle brightness of the lowest gray-scale value is the greatest. In order to reduce the effect of the lowest gray-scale value, the lowest gray-scale value is used as the common gray-scale value of the red sub-pixel 111, the green sub-pixel 112 and the blue sub-pixel 113 to form the first gray-scale value group (C, C, C). The minimum non-zero gray-scale data in a difference group obtained by subtracting the lowest gray-scale value respectively from the gray-scale values corresponding to the red sub-pixel 111, the green sub-pixel 112 and the blue sub-pixel 113 in the original gray-scale data is used as common gray-scale data of the non-zero gray-scale data in the difference group, so as to form the second gray-scale value group (B-C, B-C, 0). The first gray-scale value group and the second gray-scale value group are subtracted from the gray-scale values corresponding to the red sub-pixel 111, the green sub-pixel 112 and the blue sub-pixel 113 in the original gray-scale data group, an obtained difference being used as the third gray-scale value group (A-B, 0, 0). Such setting is to achieve that the lowest gray-scale value can be removed from the second gray-scale value group and the third gray-scale value group, the effect of the lowest gray-scale value on the color shift under a large-viewing-angle condition when the second gray-scale value group and the third gray-scale value group are displayed can be eliminated. In the overall effect of three groups of gray-scale values continuously displayed, it can be seen from the brightness variation characteristics of the unitary color under the large-viewing-angle condition of the liquid crystal display that the ratio of the sum of the dominant color gray-scale values after decomposition to the lower gray-scale value is improved, and therefore, the color shift under the side-viewing-angle condition is alleviated to some extent, and the brightness of the dominant color is improved.

In the above grouping rule, the original gray-scale data group corresponding to the binary mixed color and the unitary color is decomposed into gray-scale data groups with all zero gray-scale data, so as to keep the synchronization with the execution control manner of the ternary mixed color gray-scale data group and facilitate driving and control.

Furthermore, the driving method further includes increasing the driving frequency of the pixel unit to 1 to 4 times of original driving frequency to compensate for the display speed which is lowered due to the gray-scale value decomposition. The original one gray-scale value is decomposed into three gray-scale values which are displayed in three consecutive time periods, so that the display time of a picture becomes three times of original display time, that is, the display speed is reduced to one-third of original display speed. In order to compensate for the display speed which is lowered due to the gray-scale value decomposition, the driving frequency can be increased.

In some embodiments, the driving frequency of the pixel unit is increased to 3 times of the original driving frequency to maintain the display speed of the pixel unit after the gray-scale value decomposition to be the same as the display speed before the gray-scale value decomposition. Such setting is to achieve that the smoothness of a picture displayed after the gray-scale value decomposition to be substantially the same as the smoothness of the picture displayed by the original gray-scale data, thereby alleviating the color shift problem of the liquid crystal display without impairing the original visual effect.

The driving method further includes increasing the brightness of the backlight unit 320 to 1 to 4 times to original brightness to compensate for the brightness which is lowered due to the gray-scale value decomposition. Since the process of gray-scale value decomposition is to decompose the original high gray-scale value into three new low gray-scale values, that is, in practice, a group of high voltage signals is decomposed into three groups of low voltage signals, so the brightness is lowered. On the other hand, since the original one gray-scale value is decomposed into three gray-scale values which are displayed in three consecutive time periods, the display time of a picture is three times of the original display time, that is, the display speed is one-third of the original display speed. In order to compensate for the display speed which is lowered due to the gray-scale value decomposition, the driving frequency is generally increased. After the driving frequency is increased, the brightness is lowered because the actual display time of each gray-scale data group is shorter than that at the original driving frequency. For example, if the original driving frequency is increased to three times of the original driving frequency, the actual display time of a driving signal becomes ⅓ of the original driving signal time, causing the reduction of the brightness. In order to compensate for the brightness which is lowered due to the gray-scale value decomposition, or the driving frequency increase or the joint action of the gray-scale value decomposition and the driving frequency increase, the backlight brightness can be increased.

In some embodiments, the brightness of the backlight unit 320 is increased to 3 times of the original bright to maintain the brightness of the pixel unit after the gray-scale value decomposition to be the same as the brightness before the gray-scale value decomposition. Such setting aims at that the display effect after the gray-scale value decomposition is substantially the same as the display effect of the original gray-scale data, thereby alleviating the color shift problem of the liquid crystal display without impairing the original visual effect.

In the above method, the type of the color corresponding to the original gray-scale data group to be displayed by the pixel unit is determined, the original gray-scale data group is divided into a first gray-scale data group, a second gray-scale data group and a third gray-scale data group in accordance with a set grouping rule according to the type of the color corresponding to the original gray-scale data group to be displayed by the pixel unit, and the first gray-scale data group, the second gray-scale data group and the third gray-scale data group are respectively output and displayed in three consecutive time periods. The brightness ratio of a dominant hue is increased, so that the color shift due to the large-viewing-angle dominant hue being affected by the low voltage sub-pixel is alleviated. The main signal brightness presentation under a large-viewing-angle condition is increased. Meanwhile, the brightness of the overall image display can be maintained unchanged by increasing the backlight brightness to 3 times of original brightness, and the speed of the overall image display can be maintained unchanged by increasing the driving frequency to 3 times of an original driving frequency. In addition, additional wiring on the liquid crystal display panel is not required.

According to the above driving method of the liquid crystal display device, this application further provides a liquid crystal display device using the driving method.

As shown in FIG. 1, the liquid crystal display device includes a display module 100, a drive module 200 and a backlight module 300. The display module 100 includes a plurality of pixel units 110 arranged in an array, and the pixel unit 110 includes a red sub-pixel 111, a green sub-pixel 112 and a blue sub-pixel 113. The backlight module 300 includes a power processing unit 310 and a backlight unit 320. The display module 100 is configured to display graphic and text information. The drive module 200 is configured to receive, process and output driving data to control the display module 100 to work normally. The backlight module 300 is configured to convert a direct current voltage into a high-frequency high-voltage alternating current to turn on the backlight unit 320.

The drive module 200 includes a gray-scale value decomposition processing unit 210.

The gray-scale value decomposition processing unit 210 is connected to all the red sub-pixels 111, the green sub-pixels 112 and the blue sub-pixels 113 in the display module 100, and configured to decompose an input original gray-scale data group corresponding to each of the pixel units into two new gray-scale data groups, and output gray-scale values that are respectively displayed in two consecutive time periods by the red sub-pixel 111, the green sub-pixel 112 and the blue sub-pixel 113 in each of the pixel units 110.

Furthermore, the drive module 200 further includes a driving frequency adjusting unit 220, or a backlight brightness adjusting unit 230, or a combination of the driving frequency adjusting unit 220 and the backlight brightness adjusting unit 230. The driving frequency adjusting unit 220 is configured to adjust a driving frequency. The backlight brightness adjusting unit 230 is configured to adjust the brightness of the backlight unit 320. An original gray-scale value is decomposed into two gray-scale values which are displayed in two consecutive time periods, so that the display time of a picture is twice of original display time, that is, a display speed is reduced by half of an original display speed. In order to compensate for the display speed which is lowered due to the gray-scale value decomposition, the driving frequency can be increased. A manner to increase the drive frequency may be an increase in hardware, or a change in software drivers, or an increase in hardware and a change in software drivers. Since the process of gray-scale value decomposition is to decompose the original high gray-scale value into two new low gray-scale values, that is, in practice, a group of high voltage signals is decomposed into two groups of low voltage signals, so the brightness is lowered. In order to compensate for the brightness which is lowered due to the gray-scale value decomposition, the backlight brightness can be increased, that is, the backlight intensity is improved. A manner to increase the brightness of the backlight unit 320 may be a change in hardware, or a change in software drivers, or changes in both hardware and software drivers.

According to the above liquid crystal display device, by changing the driving frequency of the drive module 200 and the backlight brightness of the backlight module 300, the liquid crystal display device can be applied to the above driving method, and the color shift under a large-viewing-angle condition is alleviated without lowering the original visual effect of the picture.

According to the above driving method of the liquid crystal display device, this application further provides another liquid crystal display device using the driving method.

As shown in FIG. 1, the liquid crystal display device includes a display module 100, a drive module 200 and a backlight module 300. The display module 100 includes a plurality of pixel units 110 arranged in an array, and the pixel unit 110 includes a red sub-pixel 111, a green sub-pixel 112 and a blue sub-pixel 113. The backlight module 300 includes a power processing unit 310 and a backlight unit 320. Therein, the display module 100 is configured to display graphic and text information. The drive module 200 is configured to receive, process and output driving data to control the display module 100 to work normally. The backlight module 300 is configured to convert a direct current voltage into a high-frequency high-voltage alternating current to turn on the backlight unit 320.

The drive module 200 includes a gray-scale data decomposition processing unit 210, a driving frequency adjusting unit 220 and a backlight brightness adjusting unit 230.

The gray-scale value decomposition processing unit 210 is connected to all the red sub-pixels 111, green sub-pixels 112 and blue sub-pixels 113 in the display module 100, and configured to decompose input original gray-scale data corresponding to the pixel unit 110 into three new gray-scale data groups and output gray-scale values corresponding to the sub-pixels in the pixel unit 110.

The driving frequency adjusting unit 220 is configured to adjust a driving frequency. The original one gray-scale value is decomposed into three gray-scale values which are displayed in three consecutive time periods, so that the display time of a picture becomes three times of original display time, that is, a display speed is reduced to one-third of an original display speed. In order to compensate for the display speed which is lowered due to gray-scale value decomposition, the driving frequency can be increased. A manner to increase the drive frequency may be an increase in hardware, or a change in software drivers, or changes in both hardware and software drivers.

The backlight brightness adjusting unit 230 is configured to adjust the brightness of the backlight unit 320. Since the process of gray-scale data decomposition is to decompose the original high gray-scale value group into three new low gray-scale value groups, that is, in practice, one high voltage signal group is decomposed into three low voltage signal groups, so the brightness is lowered. In order to compensate for the brightness which is lowered due to the gray-scale value decomposition, the backlight brightness can be increased, that is, the backlight intensity is improved. A manner to increase the brightness of the backlight unit 320 may be an increase in hardware, or a change in software drivers, or changes in both hardware and software drivers.

The "backlight unit 320" described in any of the above embodiments may be an integrated illuminant, or may be any one of a plurality of independent or interrelated illuminants. Therein, the illumination and extinction processes of any of the plurality of independent or interconnected illuminants can be separately controlled.

According to the above liquid crystal display device, by changing the driving frequency of the drive module 200 and the backlight brightness of the backlight module 300, the liquid crystal display device can be applied to the above driving method, and the color shift under a large-viewing-angle condition is alleviated without lowering the original visual effect of a picture.

Technical features in the foregoing embodiments may be combined randomly. For the brevity of description, not all possible combinations of various technical features in the foregoing embodiments are described. However, as long as combinations of these technical features do not contradict each other, it should be considered that the combinations all fall within the scope of this specification.

The foregoing embodiments only show several implementations of this application and are described in detail, but they should not be construed as a limit to the patent scope of this application. It should be noted that, a person of ordinary skill in the art may make various changes and improvements without departing from the ideas of this application, which shall all fall within the protection scope of this application. Therefore, the protection scope of the patent of this application shall be subject to the appended claims.

What is claimed is:

1. A driving method for a liquid crystal display device, the liquid crystal display device comprising a display module, the display module comprising a plurality of pixel units arranged in an array, and the driving method comprising:

determining a type of a color corresponding to an original gray-scale data group to be displayed by each of the pixel units;

dividing the original gray-scale data group into a first gray-scale data group and a second gray-scale data group in accordance with a set grouping rule according to the type of the color corresponding to the original gray-scale data group to be displayed by each of the pixel units; and outputting and displaying the first gray-scale data group and the second gray-scale data group respectively in two consecutive time periods;

wherein the pixel unit comprises a red sub-pixel, a green sub-pixel and a blue sub-pixel, and determining the type of the color corresponding to the original gray-scale data group to be displayed by each of the pixel units comprises:

determining the type of the color corresponding to original gray-scale data according to an amount of zero gray-scale data in the original gray-scale data group to be displayed by each of the pixel units, comprising:

when the original gray-scale data group does not comprise zero gray-scale data, determining that the color corresponding to the original gray-scale data group is a ternary mixed color;

when the original gray-scale data group comprises only one piece of zero gray-scale data, determining that the color corresponding to the original gray-scale data group is a binary mixed color; and when the original gray-scale data group comprises only two pieces of zero gray-scale data, determining that the color corresponding to the original gray-scale data group is a unitary color.

2. The driving method according to claim 1, wherein the color generated by the pixel unit is any one of a unitary color type, a binary mixed color type and a ternary mixed color type, and the grouping rule comprises:

using minimum original gray-scale data in the original gray-scale data group corresponding to a ternary mixed color pixel unit as common gray-scale data of the red sub-pixel, the green sub-pixel and the blue sub-pixel in the pixel unit to form the first gray-scale data group; and using a difference data group obtained by subtracting the first gray-scale data group from the original gray-scale data group corresponding to the ternary mixed color pixel unit as the second gray-scale data group.

3. The driving method according to claim 2, wherein brightness of the backlight unit is increased to 2 times of original brightness to maintain the brightness of the pixel unit after the gray-scale value decomposition to be the same as the brightness before the gray-scale value decomposition.

4. The driving method according to claim 1, wherein the color generated by the pixel unit is any one of a unitary color type, a binary mixed color type and a ternary mixed color type, and the grouping rule comprises:

using minimum non-zero gray-scale data in the original gray-scale data group corresponding to a binary mixed color pixel unit as common gray-scale data of the sub-pixels corresponding to two pieces of non-zero gray-scale data in the pixel unit to form the first gray-scale data group together with zero gray-scale data; and using a difference data group obtained by subtracting the first gray-scale data group from the original gray-scale data group as the second gray-scale data group of the pixel unit.

5. The driving method according to claim 1, wherein the color generated by the pixel unit is any one of a unitary color type, a binary mixed color type and a ternary mixed color type, and the grouping rule comprises:

using gray-scale data corresponding to half of a gray-scale value corresponding to non-zero gray-scale data in the original gray-scale data group corresponding to a unitary color pixel unit as gray-scale data of the sub-pixel corresponding to the non-zero gray-scale data in the pixel unit to respectively form the first gray-scale data group and the second gray-scale data group together with zero gray-scale data.

6. The driving method according to claim 1, further comprising:

increasing a driving frequency of each of the pixel units to 1 to 3 times of original frequency to compensate for a display speed lowered due to gray-scale value decomposition.

7. The driving method according to claim 6, wherein the driving frequency of each of the pixel units is increased to 2 times of the original driving frequency to maintain the display speed of the pixel unit after the gray-scale value decomposition to be the same as the display speed before the gray-scale value decomposition.

8. The driving method according to claim 6, wherein the liquid crystal display device further comprises a backlight module; the backlight module comprises a backlight unit configured to provide a backlight source, and the driving method further comprises:

increasing brightness of the backlight unit to 1 to 3 times of original brightness to compensate for the brightness lowered due to the gray-scale value decomposition, or driving frequency increase or joint action of the gray-scale value decomposition and the driving frequency increase.

9. A driving method for a liquid crystal display device, the liquid crystal display device comprising a display module, the display module comprising a plurality of pixel units arranged in an array, and the driving method comprising:

determining a type of a color corresponding to an original gray-scale data group to be displayed by an $n^{th}$ pixel unit;

dividing the original gray-scale data group corresponding to the $n^{th}$ pixel unit into a first gray-scale data group and a second gray-scale data group in accordance with a set grouping rule determined according to the type of the color corresponding to the original gray-scale data group to be displayed; and outputting and displaying the first gray-scale data group and the second gray-scale data group respectively in two consecutive time periods;

wherein n is an integer greater than or equal to 1;

wherein the $n^{th}$ pixel unit comprises a red sub-pixel, a green sub-pixel and a blue sub-pixel, and determining the type of the color corresponding to the original gray-scale data group to be displayed by the $n^{th}$ pixel unit comprises:

determining the type of the color corresponding to original gray-scale data according to an amount of zero gray-scale data in the original gray-scale data group to be displayed by the $n^{th}$ pixel unit, comprising:

when the original gray-scale data group does not comprise zero gray-scale data, determining that the color corresponding to the original gray-scale data group is a ternary mixed color;

when the original gray-scale data group comprises only one piece of zero gray-scale data, determining that the color corresponding to the original gray-scale data group is a binary mixed color; and when the original gray-scale data group comprises only two pieces of zero gray-scale data, determining that the color corresponding to the original gray-scale data group is a unitary color.

10. The driving method according to claim 9, wherein the color generated by the $n^{th}$ pixel unit is any one of a unitary color type, a binary mixed color type and a ternary mixed color type, and the grouping rule specifically comprises:

using minimum original gray-scale data in the original gray-scale data group corresponding to a ternary mixed color pixel unit as common gray-scale data of the red sub-pixel, the green sub-pixel and the blue sub-pixel in the $n^{th}$ pixel unit to form the first gray-scale data group; and using a difference data group obtained by subtracting the first gray-scale data group from the original gray-scale data group corresponding to the ternary mixed color pixel unit as the second gray-scale data group.

11. The driving method according to claim 9, wherein the color generated by the $n^{th}$ pixel unit is any one of a unitary color type, a binary mixed color type and a ternary mixed color type, and the grouping rule specifically comprises:

using minimum non-zero gray-scale data in the original gray-scale data group corresponding to a binary mixed color pixel unit as common gray-scale data of the sub-pixels corresponding to two pieces of non-zero gray-scale data in the $n^{th}$ pixel unit to form the first gray-scale data group together with zero gray-scale data; and using a difference data group obtained by subtracting the first gray-scale data group from the original gray-scale data group as the second gray-scale data group of the $n^{th}$ pixel unit.

12. The driving method according to claim 9, wherein the color generated by the $n^{th}$ pixel unit is any one of a unitary color type, a binary mixed color type and a ternary mixed color type, and the grouping rule specifically comprises:

using gray-scale data corresponding to half of a gray-scale value corresponding to non-zero gray-scale data in the original gray-scale data group corresponding to a unitary color pixel unit as gray-scale data of the sub-pixel corresponding to the non-zero gray-scale data in the $n^{th}$ pixel unit to respectively form the first gray-scale data group and the second gray-scale data group together with zero gray-scale data.

13. The driving method according to claim 9, further comprising:

increasing a driving frequency of each of the pixel units to 1 to 3 times of an original driving frequency to compensate for a display speed lowered due to gray-scale value decomposition.

14. The driving method according to claim 9, wherein the liquid crystal display device further comprises a backlight module; the backlight module comprises a backlight unit configured to provide a backlight source, and the driving method further comprises:

increasing brightness of the backlight unit to 1 to 3 times of original brightness to compensate for the brightness lowered due to gray-scale value decomposition, or driving frequency increase or joint action of the gray-scale value decomposition and the driving frequency increase.

15. A liquid crystal display device, comprising:

a display module, configured to display graphic and text information;

the display module including a plurality of pixel units arranged in an array;

the pixel unit comprising a red sub-pixel, a green sub-pixel and a blue sub-pixel;

a drive module, configured to receive, process and output driving data to control the display module to normally work;

the drive module comprising a gray-scale data decomposition processing unit;

the gray-scale data decomposition processing unit being configured to determining a type of a color corresponding to an original gray-scale data group to be displayed by each of the pixel units, decompose an input original gray-scale data group corresponding to each of the pixel units into two new gray-scale data groups according to the type of the color corresponding to the original gray-scale data group to be displayed by each of the pixel units, and output gray-scale values of the red sub-pixel, the green sub-pixel and the blue sub-pixel in each of the pixel units in two consecutive time periods;

the gray-scale data decomposition processing unit being connected to all the red sub-pixels, the green sub-pixels and the blue sub-pixels in the display module; and a backlight module, configured to convert a direct current voltage into a high-frequency high-voltage alternating current to turn on a backlight unit;

wherein the backlight module comprises a power processing unit and the backlight unit;

wherein determining the type of the color corresponding to the original gray-scale data group to be displayed by each of the pixel units comprises:

determining the type of the color corresponding to original gray-scale data according to an amount of zero gray-scale data in the original gray-scale data group to be displayed by each of the pixel units, comprising:

when the original gray-scale data group does not comprise zero gray-scale data, determining that the color corresponding to the original gray-scale data group is a ternary mixed color;

when the original gray-scale data group comprises only one piece of zero gray-scale data, determining that the color corresponding to the original gray-scale data group is a binary mixed color; and when the original gray-scale data group comprises only two pieces of zero gray-scale data, determining that the color corresponding to the original gray-scale data group is a unitary color.

16. The liquid crystal display device according to claim 15, wherein the drive module further comprises a driving frequency adjusting unit, or a backlight brightness adjusting unit, or both the driving frequency adjusting unit and the backlight brightness adjusting unit;

the driving frequency adjusting unit is configured to adjust a driving frequency; and the backlight brightness adjusting unit is configured to adjust brightness of the backlight unit.

* * * * *